US005245871A

United States Patent [19]

Henneuse et al.

[11] Patent Number: 5,245,871

[45] Date of Patent: Sep. 21, 1993

[54] PROCESS FOR CONTROLLING A DRILLING OPERATION

[75] Inventors: Henry Henneuse; Jean Sancho, both of Billere, France

[73] Assignee: Societe Nationale Elf Aquitaine (Production), France

[21] Appl. No.: 856,961

[22] PCT Filed: Sep. 12, 1991

[86] PCT No.: PCT/FR91/00721

§ 371 Date: Jul. 13, 1992

§ 102(e) Date: Jul. 13, 1992

[87] PCT Pub. No.: WO92/05337

PCT Pub. Date: Apr. 2, 1992

[30] Foreign Application Priority Data

Sep. 14, 1990 [FR] France ..... 90 11380

[51] Int. Cl.[5] ..... E21B 44/00; G05D 17/00

[52] U.S. Cl. ..... 73/151; 166/250

[58] Field of Search ..... 73/151, 153, 155; 166/250

[56] References Cited

U.S. PATENT DOCUMENTS

| | | | |
|---|---|---|---|
| 2,691,300 | 10/1954 | Morris | 73/151 |
| 2,775,889 | 1/1957 | Decker | 73/151 |
| 2,810,546 | 10/1957 | Eaton et al. | 73/151 |
| 3,703,096 | 11/1972 | Vetter et al. | 73/151 |
| 3,788,136 | 1/1974 | Park | 73/151 |
| 3,837,223 | 9/1974 | Richter et al. | 73/151 |
| 4,250,758 | 2/1981 | Pitts et al. | 73/151 |
| 4,285,236 | 8/1981 | Chien | 73/151 |
| 4,773,263 | 9/1988 | Lesage et al. | 73/151 |
| 4,958,125 | 9/1990 | Jardine et al. | 73/151 |
| 5,138,875 | 8/1992 | Booer | 73/151 |

*Primary Examiner*—Hezron E. Williams
*Assistant Examiner*—George M. Dombroske
*Attorney, Agent, or Firm*—Bacon & Thomas

[57] ABSTRACT

Method for conducting an oil drilling operation, during which a drill-stem produces the rotation of a tool in an oil well. The method consists of the following steps: continually measuring the rotational speed of the upper end of the drill-stem; continuously measuring the torque applied to that end of the drill-stem; determining the torque applied to that end of the drill-stem; determining the torque variation; establishing the period of torque variation if the amplitude of the variation exceeds a predefined threshold; verifying the stability of this period; comparing the latter, if stable, with at least one predefined theoretical period; and reporting the results obtained to the user in order to control the drilling operation.

1 Claim, 4 Drawing Sheets

PROCESS FOR CONTROLLING A DRILLING OPERATION

BACKGROUND OF THE INVENTION

The present invention relates to a process for controlling a drilling operation.

During the drilling of an oil well, the motor of the drill-rod string, which is mounted on the surface, rotates at a constant speed of approximately 50 to 150 revolutions per minute. However, the friction generated between the drilling tool and the bottom of the well or between the rods and the wall of the well can cause slowdowns and indeed even periodic stops of the tool. Since the motor continues to rotate at one end of the drill-rod string during this time, the latter tends to twist about its longitudinal axis, until the force exerted is greater than the frictional effect braking the tool. At this moment, the drill-rod string is relieved and the tool begins to rotate again at speeds which can reach peak rotational speeds of the order of 150 to 400 revolutions per minute. Since wells often follow broken paths, contact between the casing and the wall of the well occurs somewhat frequently.

It is clear that the behaviour of the tool has an important effect on the progress of the drilling operation. It is therefore desirable that the foreman driller be warned of periodic instabilities in the rotational speed of the tool, so that he can modify the drilling parameters, namely the rotational speed of the motor, the weight exerted on the tool and the mud flow rate, and thus ensure optimum drilling.

SUMMARY OF THE INVENTION

The object of the present invention is, therefore, to provide a process for controlling a drilling operation, which makes it possible to supply a user in a simple way with data relating to the state of rotation of the rod.

To achieve this, the invention provides a process for controlling a drilling operation, during which a tool is set in rotation in a well by means of a drill rod, the process involving the following steps:

measurement of the rotational speed of the upper end of the rod in a continuous manner;

continuous measurement of the torque exerted on this end of the rod;

ascertainment of the variation in the torque;

determination of the period of variation of the torque, if the amplitude of this variation exceeds a predetermined threshold;

check of the stability of this period;

if this period is stable, comparison of said period with at least one predetermined theoretical period;

signalling of the results obtained to a user in order to make it possible to control the drilling operation.

BRIEF DESCRIPTION OF THE DRAWINGS

Other characteristics and advantages of the present invention will emerge more clearly from a reading of the following description with reference to the accompanying drawings in which.

DETAILED DESCRIPTION OF A PREFERRED EMBODIMENT

Figure 1:
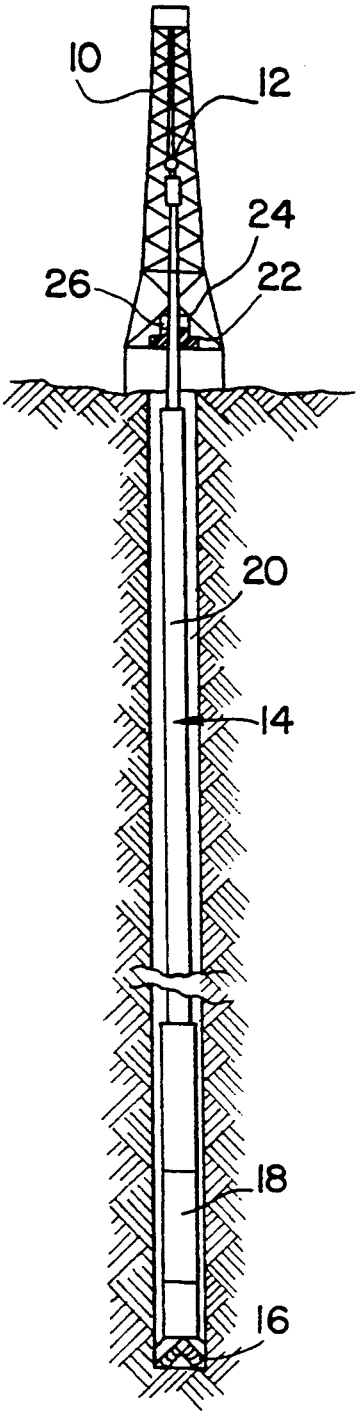
FIG. 1 is a diagrammatic sectional view of a drilling assembly.

As illustrated in FIG. 1, a drilling assembly comprises a mast 10 equipped in a way known per se with a hook 12, on which is suspended a drill-rod string designated as a whole by 14. The drill-rod string 14 comprises a drilling tool 16, drill stems 18 and drill rods 20 forming an assembly called a drilling casing. In the example illustrated, the drill-rod string 14 is set in rotation by means of a turntable 22. Any other device can be used. The turntable 22 is equipped with a rotational-speed sensor 24 and with a sensor 26 for detecting the torque exerted on the drill-rod string 14.

Starting from the data representing the rotational speed and the torque, it is possible, according to the invention, to carry out a detection of the periodic rotational instabilities.

For this purpose, the following steps must be performed:

ascertainment of the variation in the torque:

To see whether the torque variations during a given period of time are pronounced, the difference between the maximum torque and the minimum torque is determined and this result is divided by the average torque. If the result of this calculation is greater than 10%, it can be assumed that there are periodic instabilities in the rotational speed of the casing.

Figure 2:
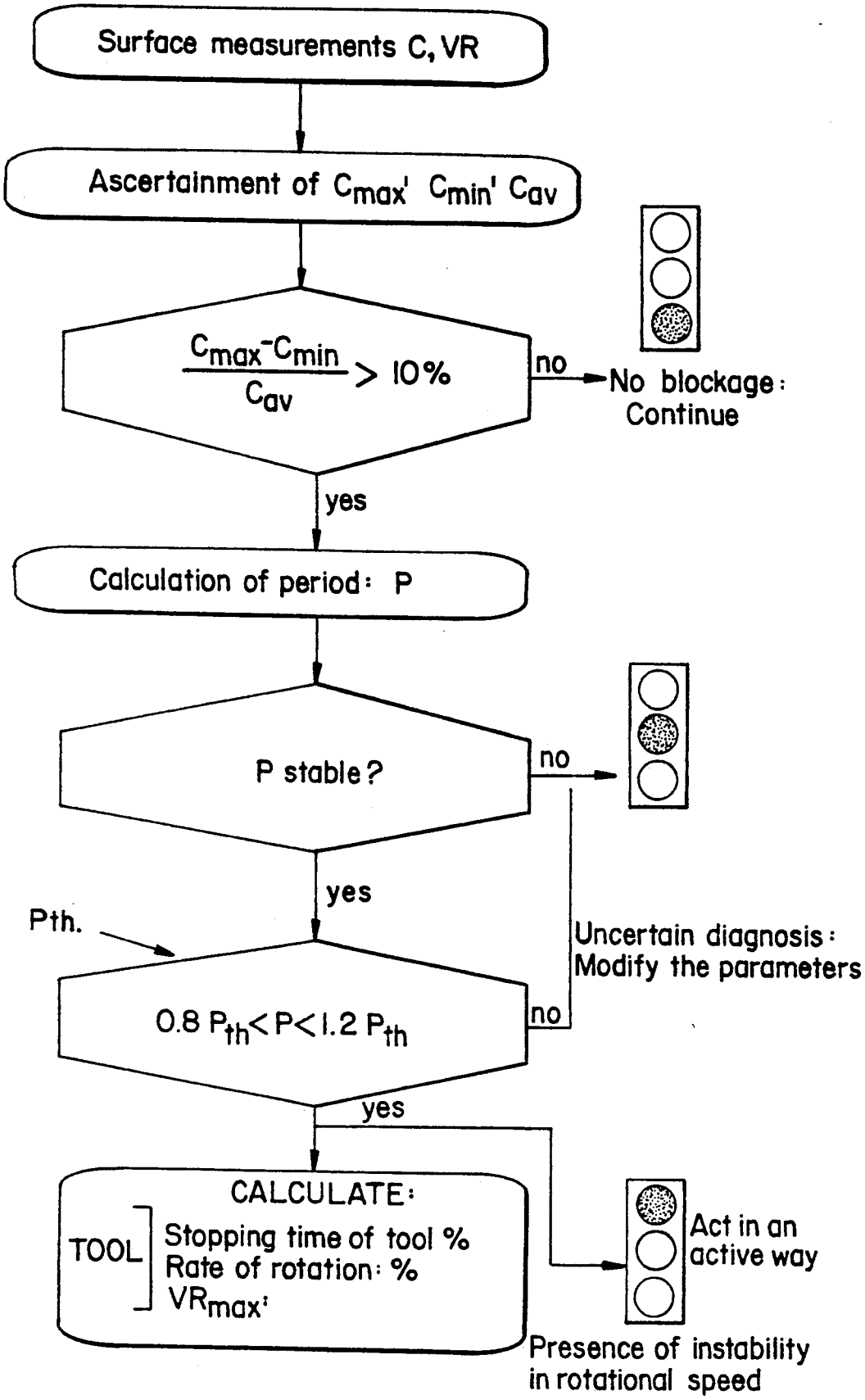
FIG. 2 is a logic diagram of some steps of the process of the invention.

This step is represented in FIG. 2 by:

$$\frac{C_{maxi} - C_{mini}}{C_{av}} > 10\%$$

A result lower than 10% implies a small torque variation which makes it possible to infer from this that there is no instability in the rotational speed of the casing. In this case, the process makes it possible to signal to the foreman driller that he can maintain the drilling parameters.

Calculation of the period P:

If the variation in the torque is pronounced, the next step of the process, in which the period P of the torque variation is calculated, is carried out. Subsequently, it is expedient to check whether this period P is constant for a predetermined number of cycles.

If it proves that the period P is not constant, it is impossible to infer that there are or are not any instabilities of rotational speed. However, since there are pronounced variations in the torque, the process makes it possible to signal this situation to the foreman driller, so that, if need be, he can modify the drilling parameters.

If the period P is constant, it is possible to pass on to the next step:

Comparison of the period P with a theoretical period:

The theoretical period $P_{th}$ is a characteristic of the casing used. It is calculated on the basis of the natural modes of torsional vibration of the casing. Since there is a plurality of natural modes of vibration, it follows from this that there is a plurality of values for $P_{th}$ which can be called $P_{th}$; $P_{th2}$, etc.

A comparison of the actual value P with each of the predetermined theoretical values is therefore carried out, in order to see whether the value P is within a range contained between 0.8 and 1.2 times the value of one of the theoretical values $P_{th}$, .

If the value P is within such a range, it can be inferred from this that there are periodic instabilities in rotational speed. The system makes it possible to signal this fact to the foreman driller, so that he can take action and modify one or more drilling parameters. In contrast, if the value P is not within such a range, there is uncertainty as to the behaviour of the drill-rod string. However, the system makes it possible to signal this uncertain situation to the foreman driller, so that, if need be, he can modify the drilling parameters.

It is subsequently expedient to proceed with a final step:

the characterisation of the phenomenon.

This step comprises two parts: the calculation of the percentage stopping time of the tool and the calculation of the maximum rotational speed of the tool.

The percentage stopping time of the tool $\%_{stopt}$ is defined by the formula $$\%_{stopt} = \frac{(\text{recovery time} - 2 \times \text{propagation time}) \times 100}{\text{period}}$$

The recovery time, during which the motor rotates and the tool is stopped, is the time necessary for the motor to overcome the friction between the casing and the well.

$$\text{This time is equal to } 60 \times \frac{DN}{VR_{av}}$$

where DN is the number of casing revolutions necessary to overcome the friction, and $VR_{av}$ is the average rotational speed of the tool.

The propagation time is given by the expression casing length wave speed in casing material The maximum rotational speed of the tool $VR_{max}$ $$VR_{max} = j \times \frac{VR \times 100}{(100 - \%_{stopt})}$$

where j is a profile coefficient which is, for example, 1.7 for the first mode of vibration.

As shown in FIG. 2, the present invention makes it possible to signal to the foreman driller, in a simple way, the presence or absence of instabilities in rotational speed. In the example illustrated, a set of indicator lamps, similar to the conventional lights intended for controlling road traffic, is employed. Any other signalling means, for example auditory or graphic, can be adopted.

In the example illustrated, a green indicator lamp indicates to the foreman driller that he can maintain the drilling parameters, an orange indicator lamp allows him the choice of modifying the parameters in view of the uncertain diagnosis, and the red indicator lamp indicates to him that he must act in an active way.

Figure 3A:
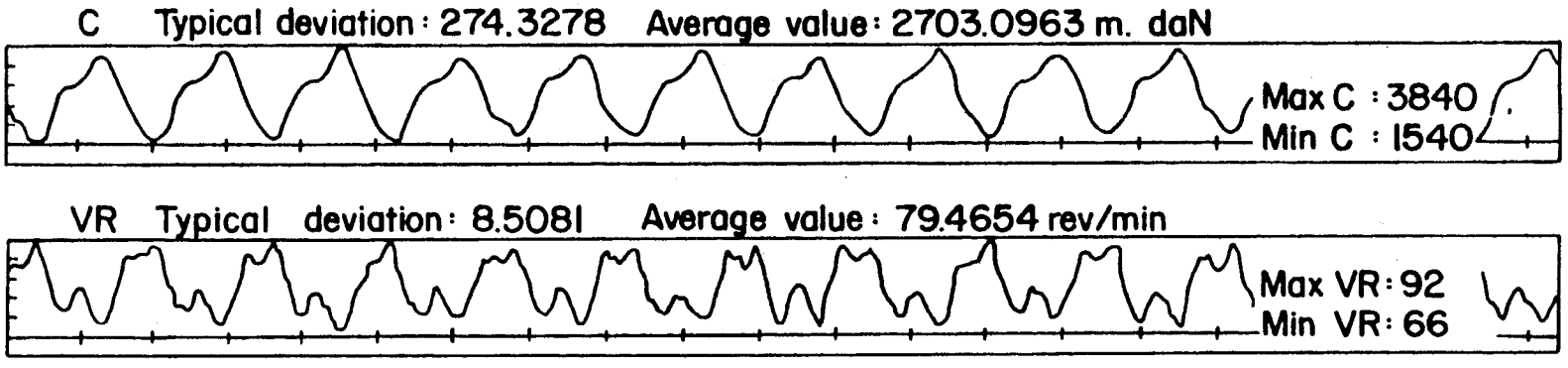
FIGS. 3A, 3B and 4 each show pairs of curves of torque and rotational speed.
Figure 3B:
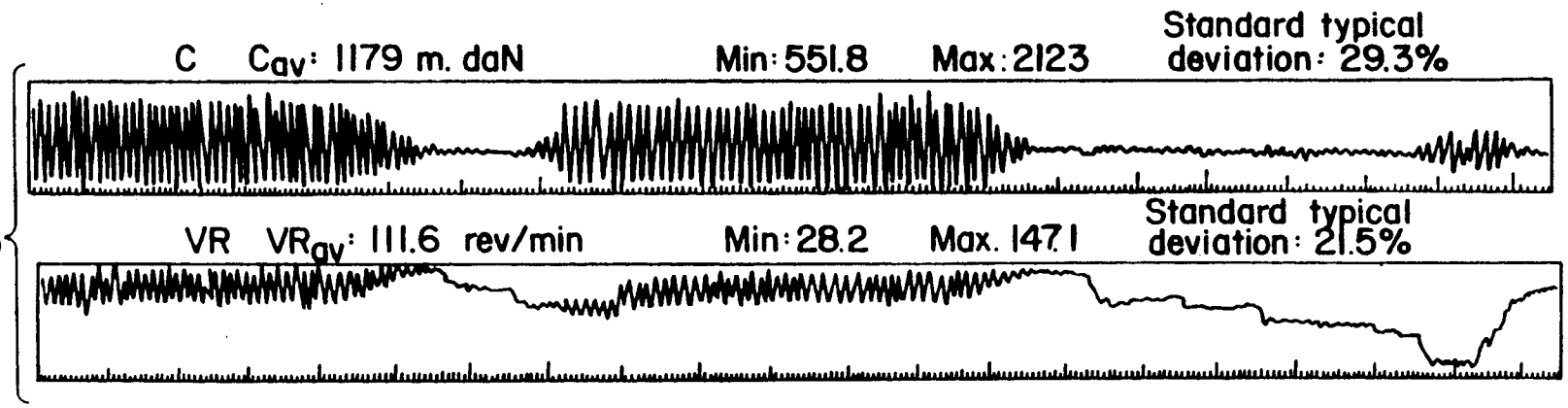
Figure 4:
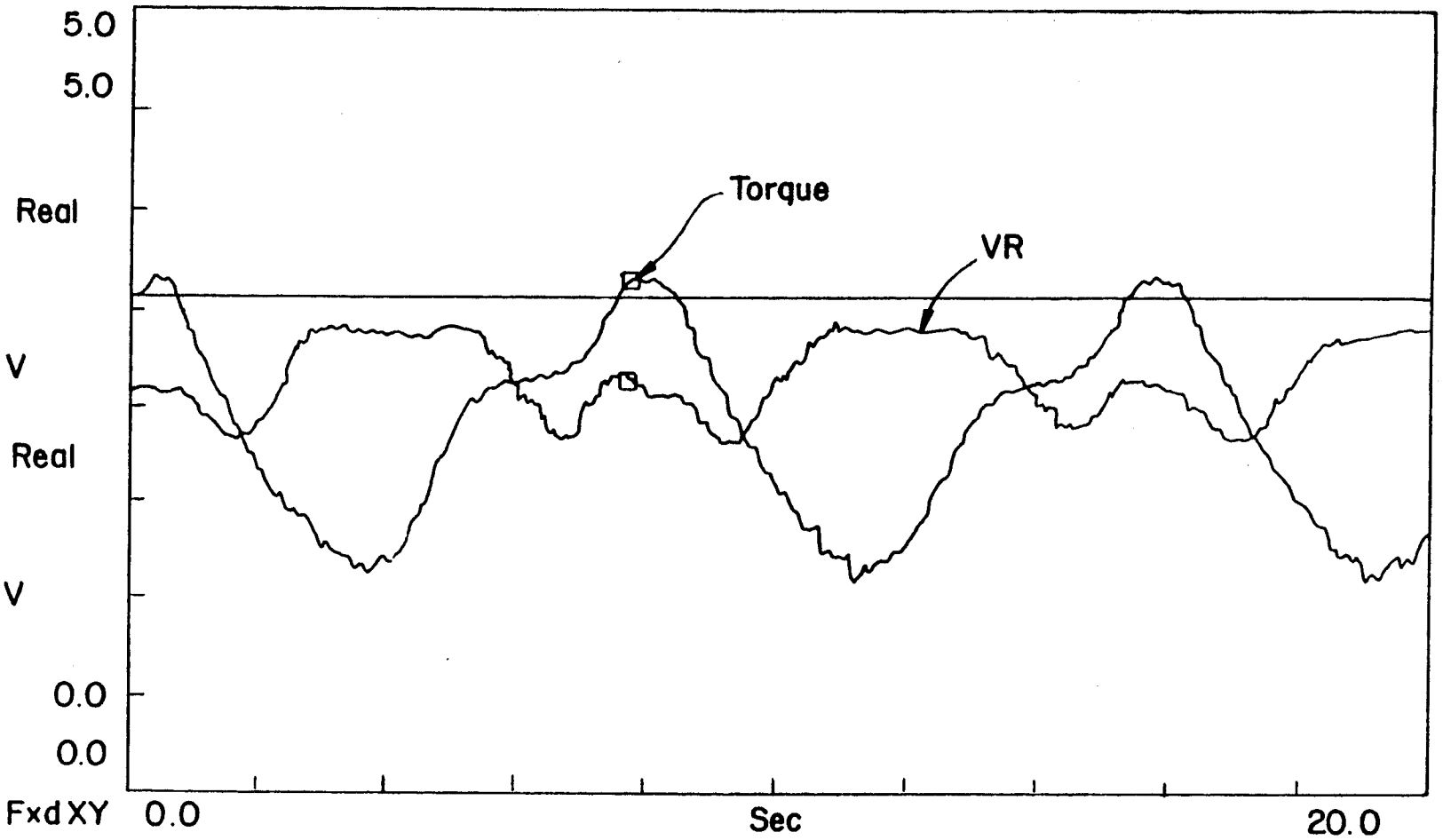

FIGS. 3A and 3B are two pairs of curves, on a different time scale, of the variation in the torque C and the rotational speed of the tool VR with time. The measurements were made by a recording device arranged at the bottom of the well. These measurements make it possible to display the ratio between the torque and the rotational speed and to confirm that this ratio corresponds to the hypotheses on which the process according to the invention is based. FIG. 4 shows in more detail the variation in the torque and in the rotational speed.

We claim:

1. Process for detecting and signalling the presence of periodic instabilities in the rotation of a drill string in order to control a drilling operation, during which a tool is set in rotation in a well by means of a drill rod, the process comprising the following steps:

continuously measuring the rotational speed of the upper end of the rod;

continuously measuring the torque exerted on the upper end of the rod;

ascertaining the variation in the torque;

determining the period of variation of the torque, if the amplitude of this variation exceeds a predetermined threshold;

checking the stability of this period;

if this period is stable, comparing said period with at least one predetermined theoretical period; and signalling the results obtained to a user in order to make it possible to control the drilling operation such that (a) if the amplitude of the torque variation does not exceed the predetermined threshold, transmitting a signal to the user that the current drilling operation can be maintained;

(b) if the period is not stable or if the period is stable but does not correspond to a predetermined theoretical period, transmitting a signal to the user to modify the current drilling operation; and (c) if the period is stable and corresponds to a predetermined theoretical period, transmitting a signal to the user that a potential instability in the drilling operation may exist.

* * * * *